US005954453A

United States Patent [19]

Thomas

[11] Patent Number: 5,954,453

[45] Date of Patent: Sep. 21, 1999

[54] METHOD OF ASSEMBLING SECTIONS OF SUPPORT LEGS OF AN OIL PLATFORM

[75] Inventor: Pierre-Armand Thomas, Puteaux, France

[73] Assignee: Technip Geoproduction, Paris, France

[21] Appl. No.: 09/018,303

[22] Filed: Feb. 3, 1998

[30] Foreign Application Priority Data

Mar. 7, 1997 [FR] France ..... 97 02763

[51] Int. Cl.[6] ..... E02B 17/00

[52] U.S. Cl. ..... 405/198; 405/195.1; 405/196

[58] Field of Search ..... 405/196, 198, 405/197, 195.1, 204, 199, 200, 201, 227, 226

[56] References Cited

U.S. PATENT DOCUMENTS

| | | | |
|---|---|---|---|
| 3,014,346 | 12/1961 | Small | 405/198 |
| 3,183,676 | 5/1965 | Le Tourneau | 405/196 |
| 3,727,414 | 4/1973 | Davies | 405/196 |
| 4,255,069 | 3/1981 | Yielding | 405/198 X |
| 4,266,887 | 5/1981 | Corder . | |
| 4,269,543 | 5/1981 | Goldman et al. | 405/198 |
| 4,431,345 | 2/1984 | Inoue | 405/195.1 X |

FOREIGN PATENT DOCUMENTS

| | | |
|---|---|---|
| 745 729 | 12/1996 | European Pat. Off. . |
| 2 071 740 | 9/1981 | United Kingdom . |

*Primary Examiner*—Dennis L. Taylor
*Attorney, Agent, or Firm*—Wenderoth, Lind & Ponack, L.L.P.

[57] ABSTRACT

The invention concerns a method of assembling sections (20) of support legs (2) of an oil platform in which an opening (11) is formed in the hull and in the lower part of the drive mechanism support framework (10) for each leg (2) to pass through, the sections (20) are engaged successively in the lateral opening (11) and the sections (20) are assembled to form each leg (2).

2 Claims, 7 Drawing Sheets

METHOD OF ASSEMBLING SECTIONS OF SUPPORT LEGS OF AN OIL PLATFORM

BACKGROUND OF THE INVENTION

The present invention concerns a method of assembling sections of support legs of an offshore oil production platform.

Offshore oil production platforms generally have legs, for example three legs, resting on the seabed and a hull movable along and adjustable in height along the legs and carrying production equipment and crew quarters, among other things.

The platform is constructed and then floated out to the drilling or production site, the legs are lowered into contact with a support structure or the seabed, and then, supported on the legs, the hull is raised above sea level to a height such that it is out of range of the highest waves.

The hull is therefore movable along the support legs of the hull by means of drive mechanisms accommodated in a support framework supported by the hull and well known to the skilled person as the "jack-house".

The drive mechanisms of each support leg each include at least two opposed motor-gearbox units driving output pinions that cooperate with opposed racks mounted on the legs.

To this end, each leg passes through the hull and the corresponding support framework and is formed of superposed sections welded together.

Each section can have a height in the order of 18 meters and is generally made up of three or four vertical booms linked together by a truss of metal beams or by box-sections.

Each boom is formed by a rectangular plate and by stiffeners in the form of half-shells each welded to one of the main faces of the plate.

The rectangular plates have teeth on their lateral face which form the diametrally opposed racks adapted to cooperate with the output pinions of the drive mechanisms.

These platforms are constructed in a shipyard by first assembling the various component parts of the hull and mounting the drive mechanism support framework on the hull where each leg passes through it.

The assembled hull rests on the ground of the shipyard on appropriate support booms.

Until now two methods have been used to assemble the sections of each leg and mount them on the hull.

The first method uses a tall crane to lift a first section of each leg to a position vertically above the corresponding passage in the hull and the support framework and then to lower it progressively in order to. engage it vertically in this passage.

A second section is then lifted and positioned over the first section and these sections are then welded together.

However, this method has drawbacks because of the height of the sections, which is approximately 18 meters for legs with a height between 70 and 170 meters.

It requires the use of at least one tall crane to lift the sections one above the other and the sections are welded together at a great height, particularly in the case of the final sections, which makes the various operations difficult, complicated and subject to the vagaries of inclement weather.

Thus the operations of mounting and assembling the legs must be interrupted in the event of high winds because of the danger to personnel.

The second method consists in assembling the various components of the hull at a sufficient height above the ground of the shipyard to provide a space enabling the vertical sections to be moved under the hull.

By virtue of this space, the first section of each leg is brought vertically below the hull and then raised to position it in the passage formed in the hull and the drive mechanism support framework.

The second section is then placed under the first section and these two sections are welded together.

These various operations are repeated to construct each leg.

This assembly method also has drawbacks, however.

It requires the construction of large supports, concrete supports, for example, to support the hull, and when the various components of the hull are assembled they must be lifted, which increases the number of handling operations and consequently the cost of building the hull.

Moreover, personnel are required to ascend the distance between the hull and the ground several times a day.

SUMMARY OF THE INVENTION

An aim of the invention is to avoid these drawbacks by proposing a method that simplifies the operations of mounting and assembling the legs of an oil platform and consequently reduces the costs of manufacture.

The invention therefore consists in a method of assembling sections of support legs of an offshore oil production platform of the type comprising a hull mounted on and movable on support legs by means of drive mechanisms accommodated in a support framework supported by the hull and each including at least two opposed motor-gearbox units driving output pinions cooperating with opposed racks mounted on the legs, each of the legs passing through the hull and the corresponding support framework and being formed of superposed sections welded together. The method comprises:

forming a lateral opening in the hull and in the lower part of the support framework at the location of the passage for each leg, engaging a first section in each lateral opening and positioning it on the axis of the passage for the leg, lifting the first section of each leg in order to position the upper part of this section above the opening, positioning the motor-gearbox units and the output pinions on the racks of the first section, lifting the first section by means of the motor-gearbox units and the output pinions to bring the lower part of the first section above the opening, engaging a second section in the opening and positioning it on the axis of the first section, bringing the sections into contact, welding the sections together, raising the sections by means of the motor-gearbox units and the output pinions, engaging the sections successively in the opening and assembling them to form each leg, and closing the lateral openings formed in the hull.

In accordance with one feature of the invention, during the lifting of the leg sections the sections are guided vertically inside each drive mechanism support framework.

BRIEF DESCRIPTION OF THE DRAWINGS

The invention will be better understood from a reading of the following description given by way of example only and with reference to the accompanying drawings, in which.

DETAILED DESCRIPTION OF THE INVENTION

Figure 1:
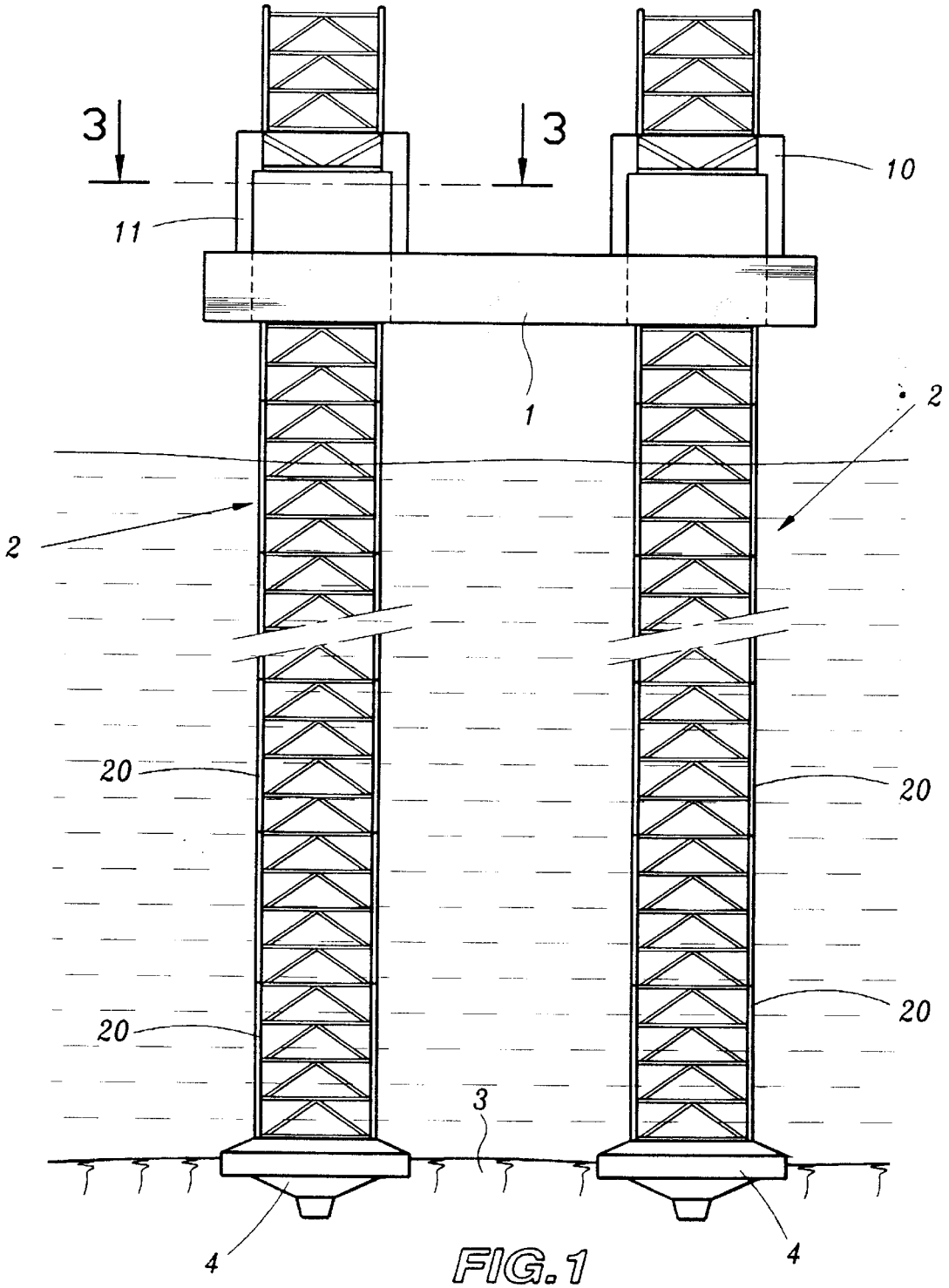
FIG. 1 is a schematic elevation view of a self-raising oil platform.

FIG. 1 is a schematic representation of a self-raising oil platform comprising a hull 1 provided with the usual production equipment and crew quarters.

The hull 1 is mounted on and movable on vertical legs 2 adapted to rest on the seabed 3 when the platform is in the drilling or production position.

The lower part of each leg 2 terminates in a foot 4 adapted to rest on the seabed 3.

Figure 3:
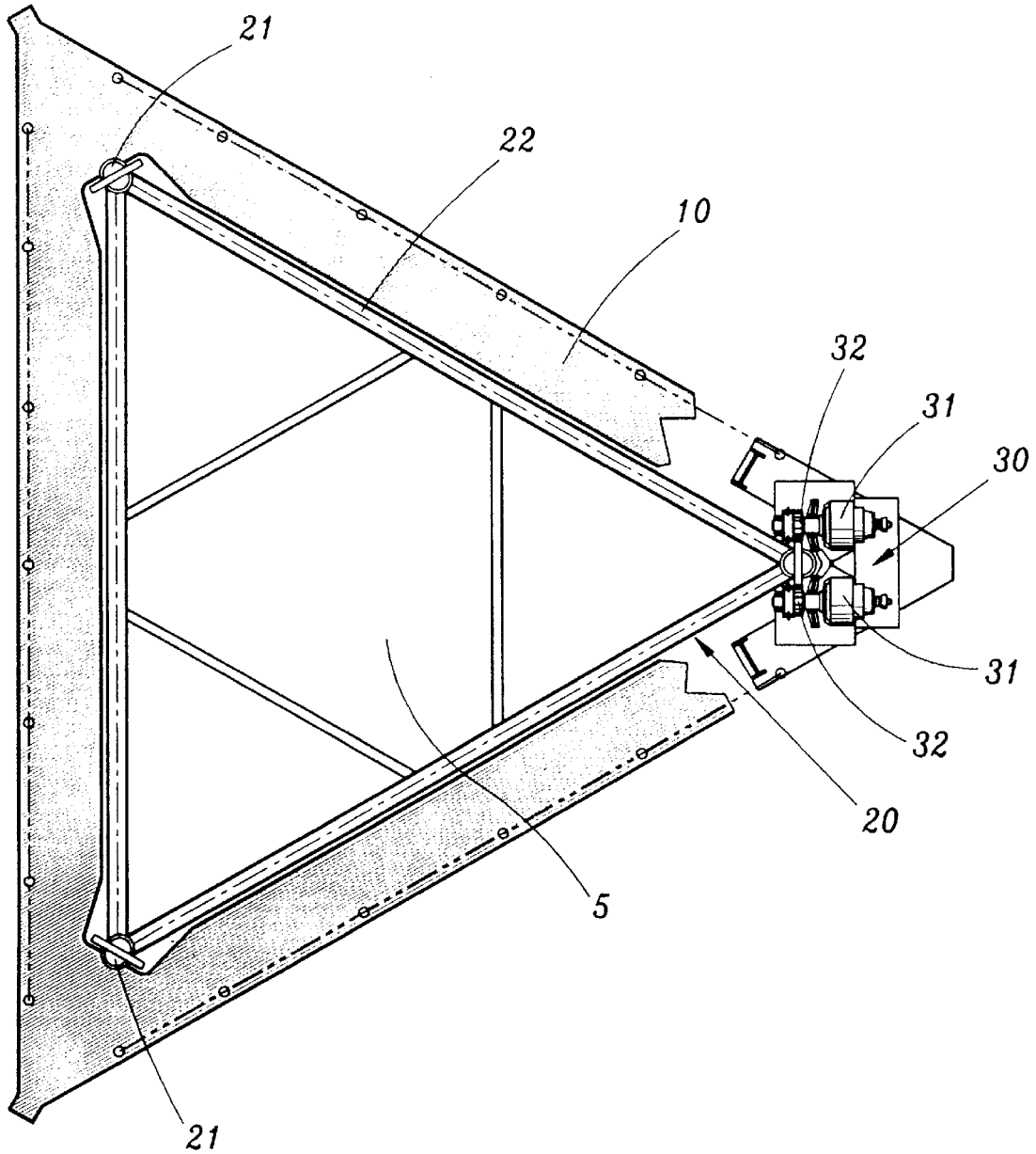
FIG. 3 is a view in section taken along the line 3—3 in FIG. 1.

As shown in FIG. 3, in this embodiment each leg 2 has a triangular section.

The legs 2 can equally well have a square or circular section.

As shown in FIG. 1, each leg 2 is formed of a plurality of sections 20 having a height in the order of 18 meters, for example, and superposed and welded together to form the leg 2.

Each leg 2 has a height in the order of 70 to 170 meters.

Figure 2:
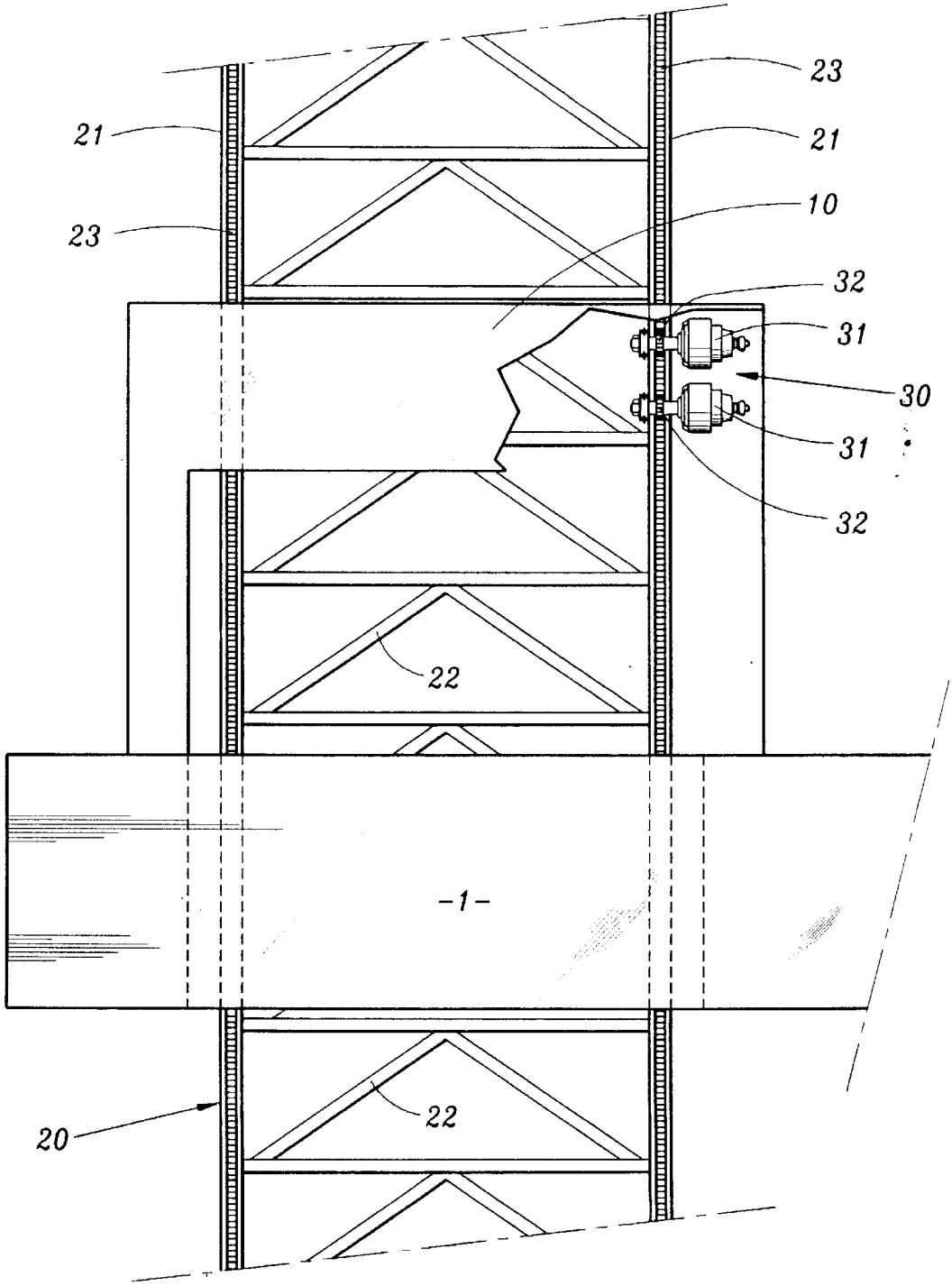
FIG. 2 is a partially cut away schematic view to a larger scale of one leg of the platform showing part of the drive mechanisms of the hull of the platform.

As shown in FIGS. 2 and 3 in particular, each section 20 of the legs 2 is formed of three booms 21 linked by a truss of metal beams 22 or by box-sections.

The booms 21 of the sections 20 have teeth which form on each boom 21 two diametrally opposed racks 23 adapted to cooperate with drive mechanisms 30 to move the hull 1 on the vertical legs 2.

The drive mechanisms 30 for each vertical leg 2 are accommodated in the support framework 10 known to the skilled person as the "jack-house".

Each support framework 10 is supported by the hull 1, as shown in FIG. 1.

The drive mechanisms 30 are formed by motor-gearbox units 31 each driving an output pinion 32 cooperating with the racks 23 on the booms 21 of each vertical leg 2.

To this end each leg 2 passes through a vertical passage 5 in the hull 1 and the corresponding support framework 10.

The drive mechanisms 30 lower the legs 2 into contact with the seabed 3 and then, -with the hull 1 supported on the legs 2, raise the hull above the sea, to a height such that it is out of range of the highest. waves (FIG. 1).

The platform is built in the following manner.

Figure 7A:
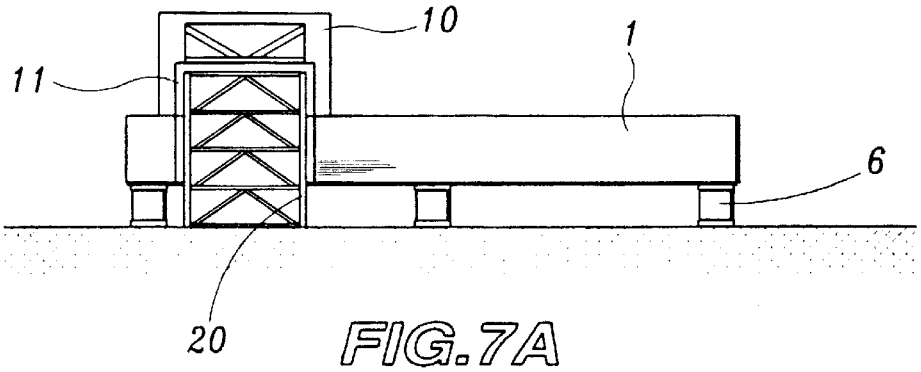
Figure 7B:
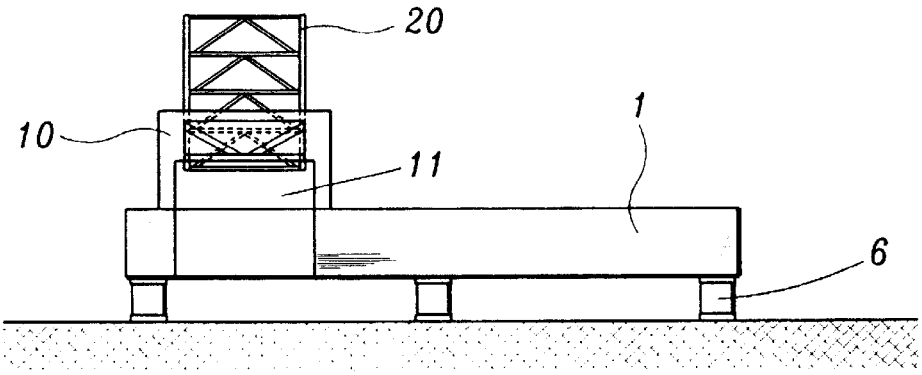
Figure 7C:
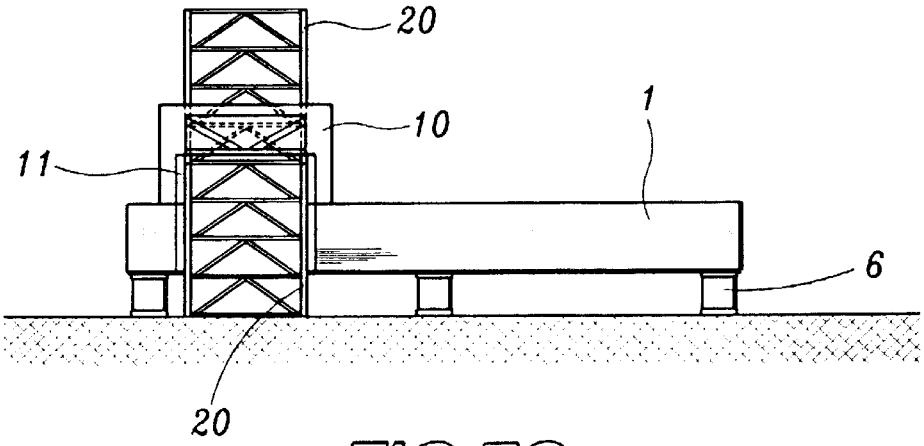

Firstly, the various components of the hull 1 are assembled in a shipyard with the hull 1 resting on supports 6 at a small distance from the ground, as shown in FIGS. 7A through 7C.

The sections 20 are then assembled to form each leg 2.

Figure 4:
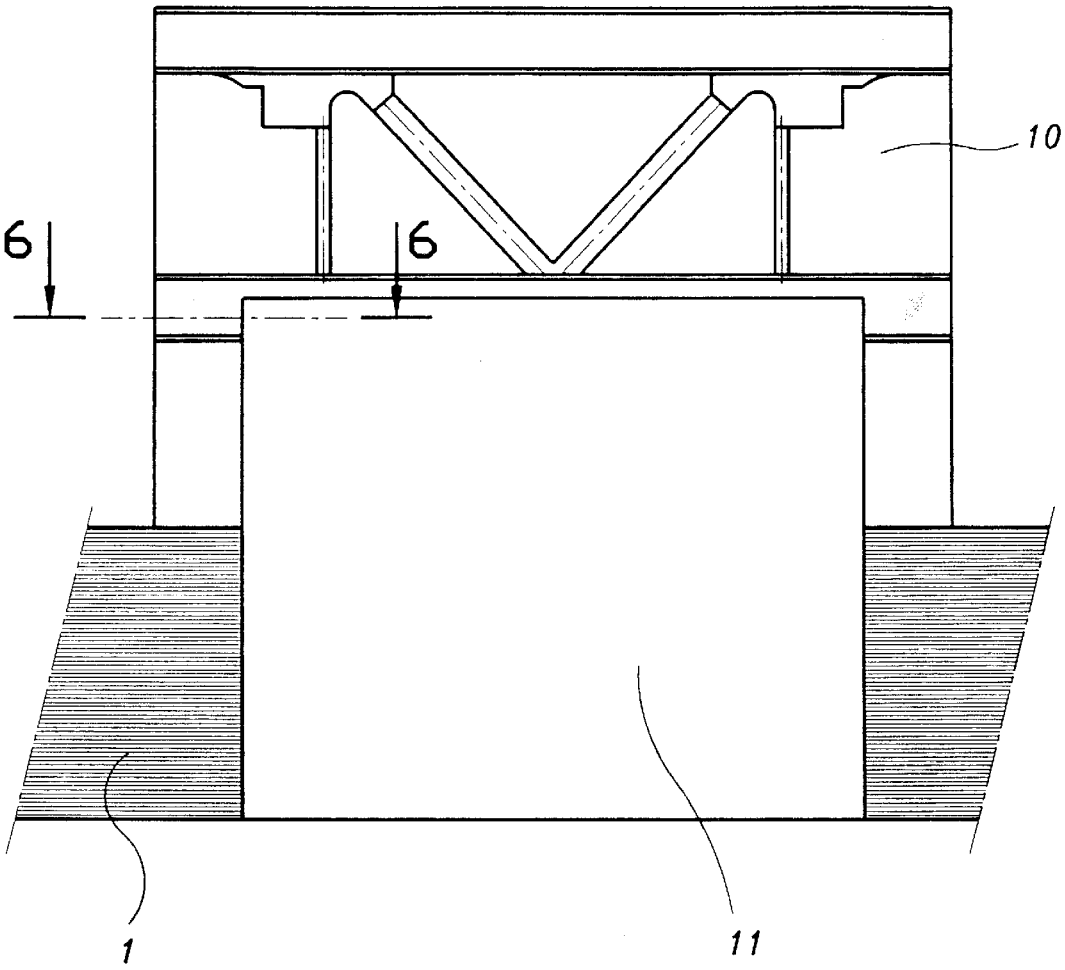
FIG. 4 is a side view of part of the platform showing the lateral opening formed in the platform for executing the method of the invention.
Figure 5:
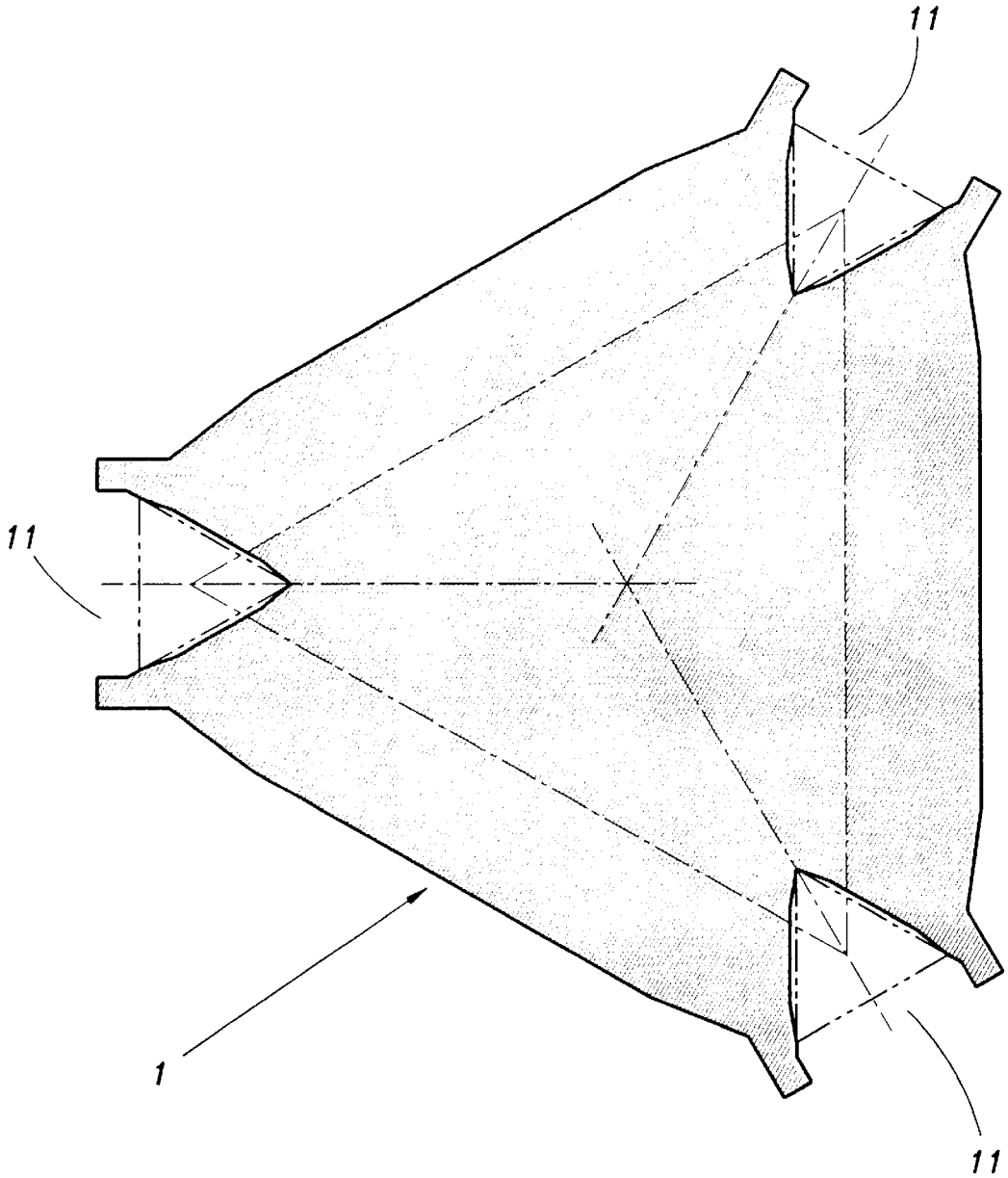
FIG. 5 is a schematic plan view of the platform.

To this end, and as shown in FIGS. 4 and 5, a lateral opening 11 is first formed in the hull 1 and in the lower part of the corresponding support framework 10 at the location of the passage 5 for each leg 2.

This lateral opening 11 and the distance between the hull 1 and the ground form a passage substantially corresponding to the height of a section 20.

Figure 6:
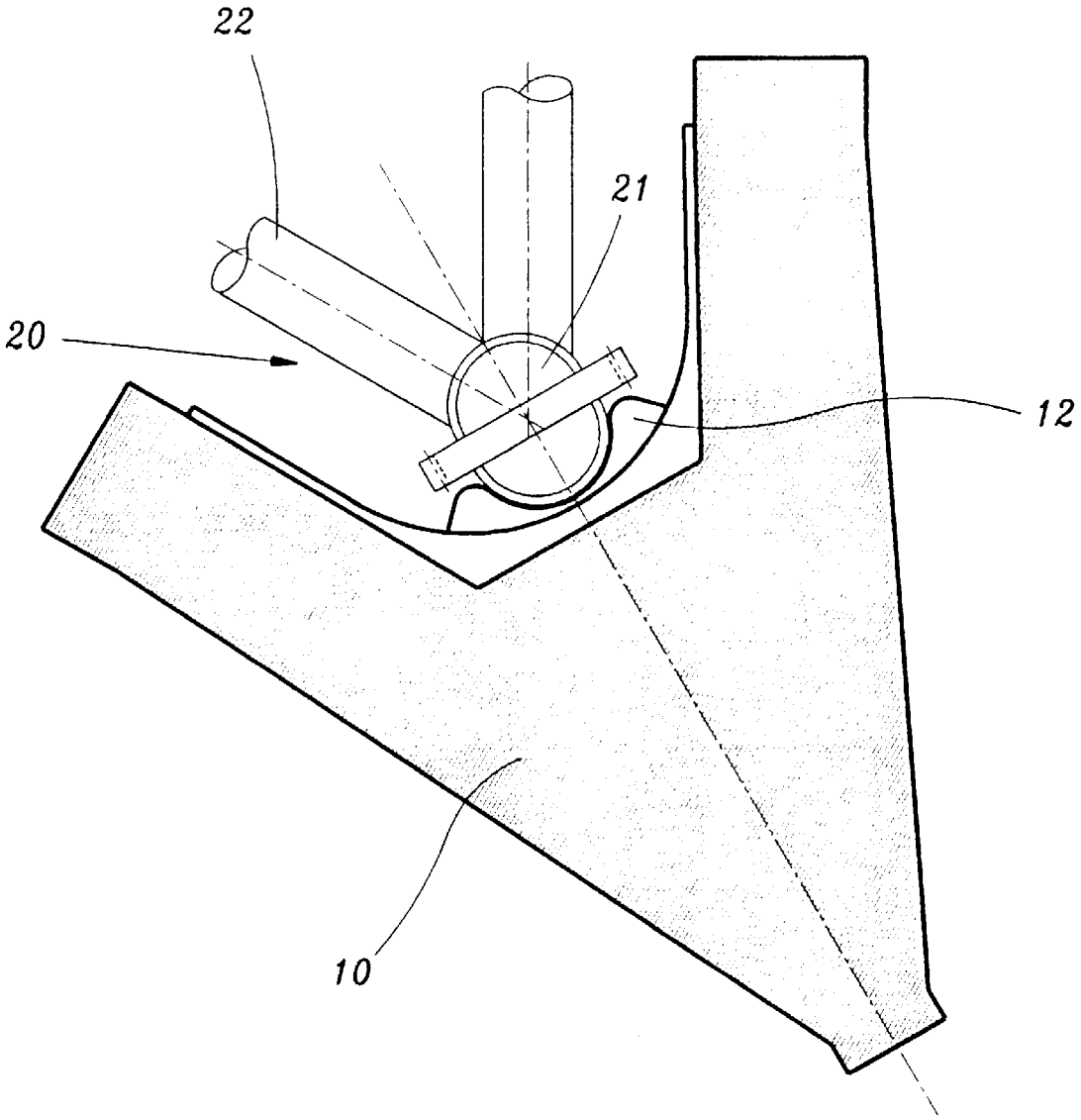
FIG. 6 is a view in section taken along the line 6—6 in FIG. 4, and FIGS. 7A through 7C are schematic elevation views of the platform showing the various steps of executing the method of the invention.

As shown in FIG. 6, each support framework 10 is equipped, where each boom 21 of the sections 20 of the legs 2 passes through it, with a guide 12 of complementary shape to a circular portion of the corresponding boom 21 and adapted to guide movement in vertical translation of the sections 20, as described later.

The mounting and the assembly of the sections 20 of one leg 2 will now be described with reference to FIGS. 7A through 7C, the mounting and the assembly of the sections of the other legs being identical.

A first section 20 is first engaged in the lateral opening 11, as shown in FIG. 7A.

The height of the lateral opening 11 and the distance between the bottom of the hull 1 and the ground forms a space sufficiently high for a section 20 to pass through it.

If this space is not sufficiently high, a complementary trench can be provided in the ground.

The first section 20 is then lifted by appropriate-means to position the upper part of the first section 20 above the lateral opening 11.

The means for lifting the first section 20 can be a crane or jack, for example.

Upon vertical translation of the first section 20 the booms 21 come into contact with the guides 12, which enables the first section 20 to be positioned on the axis of the passage 5 for the leg 2.

After this first operation, a plurality of motor-gearbox units 31 and output pinions 32 are positioned on the racks 23 of the booms 21 of the first section 20.

The first section 20 is then raised by the motor-gearbox units 31 and the output pinions 32 in order to position the lower part of the first section 20 above the lateral opening 11, as shown in FIG. 7B.

The lateral opening 11 being exposed in this way, a second section 20 is engaged in this lateral opening 11 and positioned on the axis of the previously raised first section 20.

The motor-gearbox units 31 and the output pinions 32 are used to lower the first section 20 to bring the first section 20 into contact with the second section 20, as shown in FIG. 7C.

Alternatively, the second section 20 could be raised into contact with the first section 20.

The sections 20 are then welded together and raised by means of the motor-gearbox units 31 and output pinions 32 to expose the lateral opening 11 to enable the positioning of another section 20.

In this way the sections 20 forming a leg 2 are introduced and assembled successively to form each leg 2.

After assembling the various sections 20 constituting the leg 2, the lateral opening formed in the hull 1 is closed.

The method of the invention therefore simplifies the operations of mounting and assembling the legs of an oil platform and consequently reduces the costs of manufacture.

The method of the invention reduces handling operations and prevents the various operations of assembling the sections of the legs being subject to the vagaries of inclement weather.

By virtue of the method of the invention, the operations of assembling the sections are carried out in fixed workshops at the level of the hull of the platform.

I claim:

1. A method of assembling sections of support legs of an offshore oil production platform of the type comprising a hull (1) mounted on and movable on support legs (2) by means of drive mechanisms (30) accommodated in a support framework (10) supported by the hull (1) and each including at least two opposed motor-gearbox units (31) driving output pinions (32) cooperating with opposed racks (23) mounted on the legs (2), each of said legs (2) passing through the hull (1) and the corresponding support framework (10) and being formed of superposed sections (20) welded together, wherein the method comprises:

forming a lateral opening (11) in the hull (1) and in the lower part of the support framework (10) at the location of the passage for each leg (2), engaging a first section (20) in each lateral opening (11) and positioning it on the axis of the passage (5) for the leg (2), lifting the first section (20) of each leg (2) in order to position the upper part of this section (20) above the opening (11), positioning the motor-gearbox units (31) and the output pinions (32) on the racks (23) of the first section (20), lifting the first section (20) by means of the motor-gearbox units (31) and the output pinions (32) to bring the lower part of said first section (20) above the opening (11), engaging a second section (20) in the opening (11) and positioning it on the axis of the first section (20), bringing the sections (20) into contact, welding said sections (20) together, raising the sections (20) by means of the motor-gearbox units (31) and the output pinions (32), engaging the sections (20) successively in the opening (11) and assembling them to form each leg (2), and closing the lateral openings (11) formed in the hull (1).

2. A method according to claim 1, wherein during the lifting of the sections (20) of the legs (2) the sections (20) are guided laterally inside each support framework (10).

* * * * *